US011079693B2

(12) United States Patent
Kunisawa

(10) Patent No.: US 11,079,693 B2
(45) Date of Patent: Aug. 3, 2021

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventor: Eri Kunisawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/722,053

(22) Filed: Dec. 20, 2019

(65) Prior Publication Data

US 2020/0310261 A1 Oct. 1, 2020

(30) Foreign Application Priority Data

Apr. 1, 2019 (JP) ..... JP2019-069785

(51) Int. Cl.
*G03G 5/14* (2006.01)
*G03G 5/047* (2006.01)
*G03G 5/147* (2006.01)

(52) U.S. Cl.
CPC ..... *G03G 5/144* (2013.01); *G03G 5/047* (2013.01); *G03G 5/14704* (2013.01)

(58) Field of Classification Search
CPC ..... G03G 5/144
See application file for complete search history.

(56) References Cited

U.S. PATENT DOCUMENTS 5,958,638 A * 9/1999 Katayama ..... G03G 5/0659 430/131
2014/0127615 A1* 5/2014 Nakamura ..... G03G 5/142 430/56
2014/0178809 A1* 6/2014 Matsusaki ..... G03G 5/144 430/60
2017/0277047 A1* 9/2017 Sugiura ..... G03G 5/043
2018/0164707 A1* 6/2018 Haruyama ..... G03G 5/10
2020/0117105 A1* 4/2020 Watanabe ..... G03G 5/144

FOREIGN PATENT DOCUMENTS

JP 2000-321805 A 11/2000
JP 2011-118311 A 6/2011

* cited by examiner

*Primary Examiner* — Christopher D Rodee
(74) *Attorney, Agent, or Firm* — Sughrue Mion, PLLC

(57) ABSTRACT

An electrophotographic photoreceptor includes: a conductive substrate; an undercoating layer that contains inorganic particles surface-treated with a surface treatment agent, and is provided in contact with an outer peripheral surface of the conductive substrate; and a photosensitive layer provided on the undercoating layer, wherein, with respect to the outer peripheral surface of the conductive substrate, a proportion of an area being in contact with the inorganic particles is from 82% to 91%.

9 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-069785 filed on Apr. 1, 2019.

BACKGROUND

(i) Technical Field

The present invention relates to an electrophotographic photoreceptor, a process cartridge, and an image forming apparatus.

(ii) Related Art

JP-A-2011-118311 discloses an electrophotographic photoreceptor including a support and a photosensitive layer provided on the support, in which the photosensitive layer contains hollow particles each having a void therein.

JP-A-2000-321805 discloses an electrophotographic photoreceptor including an undercoat layer, a charge generation layer, and a charge transport layer, which are sequentially provided on a conductive substrate, in which when a voltage of 5 V/μm is applied to the undercoat layer, the undercoat layer has electron mobility of $10^{-12}$ $cm^2/V \cdot s$ or more.

SUMMARY

In a case where an electrophotographic photoreceptor includes an undercoating layer contains inorganic particles, in order to improve dispersibility of the inorganic particles, for example, surface-treated inorganic particles may be used in the undercoating layer.

However, with respect to an electrophotographic photoreceptor including an undercoating layer containing the surface-treated inorganic particles which is provided in contact with the conductive substrate, conductivity on an outer peripheral surface of the conductive substrate partially decreases with time as the photoreceptor is used, thereby causing density unevenness in an obtained image in some cases.

Aspects of non-limiting embodiments of the present disclosure relate to an electrophotographic photoreceptor including an undercoating layer that contains inorganic particles surface-treated with a surface treatment agent, and is provided in contact with an outer peripheral surface of a conductive substrate, and providing an image in which density unevenness is prevented as compared with an electrophotographic photoreceptor where, with respect to the outer peripheral surface of the conductive substrate, a proportion of an area being in contact with the inorganic particles is more than 91%.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor including:

a conductive substrate;

an undercoating layer that contains inorganic particles surface-treated with a surface treatment agent, and is provided in contact with an outer peripheral surface of the conductive substrate; and a photosensitive layer provided on the undercoating layer, wherein, with respect to the outer peripheral surface of the conductive substrate, a proportion of an area being in contact with the inorganic particles is from 82% to 91%.

BRIEF DESCRIPTION OF THE DRAWINGS

Exemplary embodiments of the present invention will be described in detail based on the following figures, wherein.

DETAILED DESCRIPTION

Figure 1:
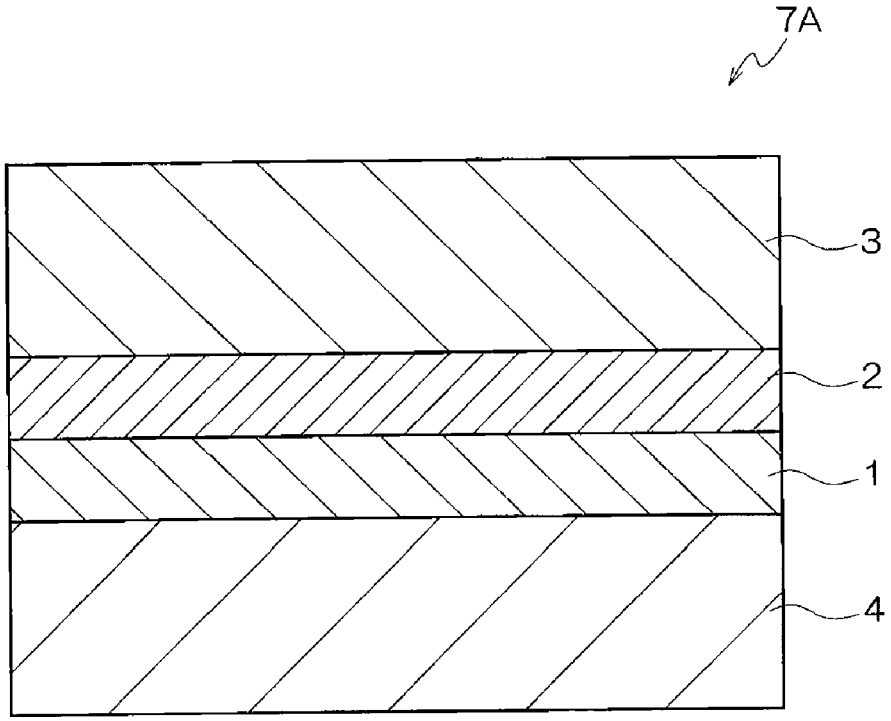
FIG. 1 is a schematic sectional diagram illustrating an example of a layer configuration of an electrophotographic photoreceptor according to an exemplary embodiment.

Hereinafter, an exemplary embodiment of the invention will be described. These descriptions and examples are illustrative of exemplary embodiments and do not limit the scope of the invention.

Electrophotographic Photoreceptor

First Aspect

An electrophotographic photoreceptor (hereinafter also referred to as "photoreceptor") according to the first aspect includes a conductive substrate, an undercoating layer that contains inorganic particles surface-treated with a surface treatment agent, and is provided in contact with an outer peripheral surface of the conductive substrate, and a photosensitive layer provided on the undercoating layer, in which, with respect to the outer peripheral surface of the conductive substrate, a proportion of an area being in contact with the inorganic particles (hereinafter also referred to as "inorganic particle contact proportion") is from 82% to 91%.

In the first aspect, the photoreceptor includes the undercoating layer that contains the inorganic particles surface-treated with the surface treatment agent, and is provided in contact with the outer peripheral surface of the conductive substrate. In the photoreceptor, as compared with a case where, in the outer peripheral surface of the conductive substrate, a proportion of an area being in contact with the inorganic particles is more than 91%, an image in which density unevenness is prevented is formed. The reason for this is not certain but is presumed as follows.

In a case where the undercoating layer contains inorganic particles, for example, surface-treated inorganic particles may be used in order to improve dispersibility of the inorganic particles in the undercoating layer. However, when the undercoating layer containing the surface-treated inorganic particles is provided in contact with the conductive substrate, a surface of the conductive substrate on a side in contact with the undercoating layer (that is, the outer peripheral surface) nay corrode due to the effect of the surface treatment agent so that an oxide film may be formed on the outer peripheral surface. When the oxide film is partially formed on the outer peripheral surface of the conductive substrate, conductivity of an area where the oxide film is formed is reduced, and the amount of current flowing from the undercoating layer to the conductive substrate is reduced. Thus, a density of an image to be obtained may partially be lowered to cause the density unevenness of the image.

On the other hand, in the first aspect, the inorganic particle contact proportion is from 82% to 91%. Therefore, it is considered that the outer peripheral surface of the conductive substrate is less affected by the surface treatment agent, as compared with a case where the inorganic particle contact proportion is more than 91%. Thus, the oxide film is unlikely to be formed on the outer peripheral surface of the conductive substrate. Accordingly, the amount of the current flowing from the undercoating layer to the conductive substrate is also prevented from being reduced. Therefore, it is presumed that a density of an image to be obtained is prevented from being partially lowered and as a result, the density unevenness of the image is prevented.

Here, the "inorganic particle contact proportion" is a value obtained by the following measurement. Specifically, the photoreceptor to be measured is cut with an aluminum cutter along a thickness direction. A section of the conductive substrate and the undercoating layer is observed at 20× magnification, using a scanning electron microscope (Keyence Corporation, model number: VHX-D500), thereby obtaining a section image. In the obtained section image, an interface between the conductive substrate and the undercoating layer is analyzed over a range of 1 mm, and the interface is divided into an area where the inorganic particles in the undercoating layer are in contact with the outer peripheral surface of the conductive substrate and an area where the inorganic particles in the undercoating layer are not in contact with the outer peripheral surface of the conductive substrate. Then, in the analyzed 1 mm interface, a proportion (%) of the area where there are the inorganic particles being in contact with the outer peripheral surface of the conductive substrate is determined and set as the "inorganic particle contact proportion".

The "contact" is not limited to a state in which the surface of the inorganic particles and the outer peripheral surface of the conductive substrate are strictly in contact with each other, and also includes a case where, in the section image, the inorganic particles are considered to be in a state of being in contact with the outer peripheral surface of the conductive substrate. Specifically, when observing by magnification, even in a case where there is a slight gap between the surface of the inorganic particles and the outer peripheral surface of the conductive substrate, a case where the shortest distance between the outer peripheral surface of the conductive substrate and the surface of the inorganic particles is 5 μm or less is regarded as being in "a state of being in contact".

Second Aspect

A photoreceptor according to a second aspect includes a conductive substrate, an undercoating layer that contains inorganic particles surface-treated with a surface treatment agent, and is provided in contact with an outer peripheral surface of the conductive substrate, and a photosensitive layer provided on the undercoating layer, wherein, when halftone full page images having an image density of 50% are continuously formed on 2 million sheets of A4 paper, a rate of decrease in a value of current flowing from the undercoating layer to the conductive substrate (hereinafter also referred to as "current reduction rate due to use" is 20% or less. A photoreceptor according to the first aspect may be a photoreceptor according to the second aspect.

In the second aspect, the photoreceptor includes the undercoating layer that contains the inorganic particles surface-treated with the surface treatment agent, and is provided in contact with the outer peripheral surface of the conductive substrate. In the photoreceptor, as compared with a case where the current reduction rate due to use is more than 20%, an image in which density unevenness is prevented is formed. The reason for this is not certain but is presumed as shown below.

As above, when the undercoating layer containing the surface-treated inorganic particles is provided in contact with the conductive substrate, a surface of the conductive substrate on a side in contact with the undercoating layer (that is, the outer peripheral surface) may corrode due to the effect of the surface treatment agent and an oxide film may be formed on the outer peripheral surface. When the oxide film is partially formed on the outer peripheral surface of the conductive substrate, conductivity of an area where the oxide film is formed is reduced, and the amount of current flowing from the undercoating layer to the conductive substrate is reduced. Thus, a density of an obtained image may partially be lowered to cause the density unevenness of the image.

On the other hand, in the second aspect, the current reduction rate due to use is 20% or less. That is, as compared with a case where the current reduction rate due to use is more than 20%, it is unlikely to occur that the amount of current flowing from the undercoating layer to the conductive substrate is partially reduced even when forming the images continuously. Therefore, it is presumed that a density of an image to be obtained is prevented from being partially lowered and as a result, the density unevenness of the image is prevented.

Here, the "current reduction rate due to use" is a value obtained by the following measurement and calculation.

First, in an initial stage (that is, before use) of the photoreceptor to be measured, a value (A) of current flowing from the undercoating layer to the conductive substrate is measured, and the value is set as an "initial current value". In measuring the initial current value, the photosensitive layer and the like are removed at an axial end of the photoreceptor with a cutter knife to expose a part of the undercoating layer. Then, an electrode ($Ag/Ag^+$, BAS Inc., model number: RE-7, contact area: 10 $mm^2$) is attached to each of the exposed surface of the undercoating layer and an inner peripheral surface of the conductive substrate, and the initial current value is measured using ammeter (BAS Inc., model number: ALS600E). Measurement conditions for the initial current value are as follows. An environment is a temperature of 25° C. and a humidity of 40%. Potential marking speed is 0.1 V/S. A stamping range is −1 V to 1 V.

Next, a photoreceptor of which the initial current value is measured is mounted on an image forming apparatus, and halftone full page images with an image density of 50% are continuously formed on 2 million sheets of A4 paper in an environment at a temperature of 25° C. and a humidity of 40%. Image forming conditions are as follows. A charging method is scorotron. Charging voltage is −700 V.

After the image formation, in an area where the undercoating layer is not exposed in the photoreceptor, the photosensitive layer and the like are removed to expose a part of the undercoating layer. The value (A) of current flowing from the undercoating layer to the conductive substrate is measured and is set as a "current value after use".

From the obtained initial current value and the current value after use, the current reduction rate due to use is obtained by the following Equation.

Equation: Current reduction rate due to use (%)= ((Initial current value−Current value after use)/ Initial current value)×100

Hereinafter, the first aspect and the second aspect may be collectively referred to as "the exemplary embodiment". However, an example of the exemplary embodiment of the invention only has to correspond to any one of the first aspect or the second aspect.

Hereinafter, the electrophotographic photoreceptor according to the exemplary embodiment will be described in detail with reference to the drawings. In the drawings, the same or corresponding parts are denoted by the same reference numerals, and duplicated description will not be repeated.

Figure 2:
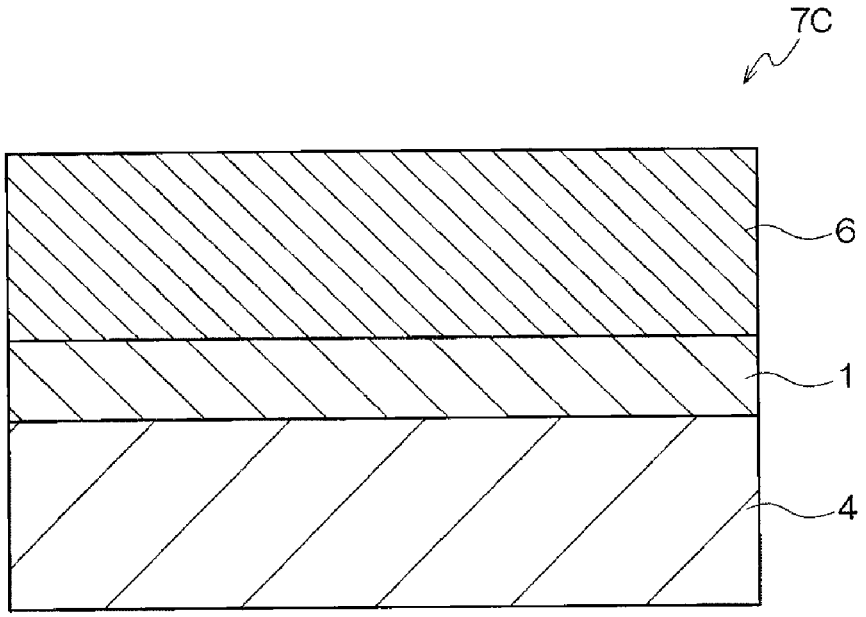
FIG. 2 is a schematic sectional diagram illustrating another example of the layer configuration of the electrophotographic photoreceptor according to the exemplary embodiment.

FIG. 1 is a schematic sectional diagram illustrating an example of the electrophotographic photoreceptor according to an exemplary embodiment. FIG. 2 is a schematic sectional diagram illustrating another example of the electrophotographic photoreceptor according to the exemplary embodiment;

An electrophotographic photoreceptor 7A shown in FIG. 1 is a function-separated photoreceptor (that is, a stacked photoreceptor) in which functions of a charge generation layer 2 and a charge transport layer 3 are separated from each other, and has a structure in which an undercoating layer 1 is provided on a conductive substrate 4, and the charge generation layer 2 and the charge transport layer 3 are sequentially formed thereon. In the electrophotographic photoreceptor 7A, the charge generation layer 2 and the charge transport layer 3 form a photosensitive layer.

An electrophotographic photoreceptor 7C shown in FIG. 2 includes a charge generation material and a charge transporting material in the same layer (a singlelayer type photosensitive layer 6). That is, the electrophotographic photoreceptor 7C shown in FIG. 2 has a structure in which the undercoating layer 1 is provided on the conductive substrate 4, and the singlelayer type photosensitive layer 6 is formed thereon.

In each of the electrophotographic photoreceptor shown in FIG. 1 and the electrophotographic photoreceptor shown in FIG. 2, other layers may further be provided as needed. Examples of the other layers include an intermediate layer provided between the undercoating layer and the photosensitive layer and a protective layer provided on the photosensitive layer.

Hereinafter, each element will be described based on the electrophotographic photoreceptor 7A shown in FIG. 1 as a representative example. Descriptions may be given without reference numerals in some cases.

Conductive Substrate

Examples of the material forming the conductive substrate include metals. Specific examples thereof include pure metal such as aluminum, iron, and copper and an alloy such as stainless steel and an aluminum alloy.

As the metal forming the conductive substrate, from the viewpoint of excellent lightness and workability, a metal containing aluminum is preferable, and pure aluminum or an aluminum alloy is more preferable. The aluminum alloy is not particularly limited as long as it is an alloy that has aluminum as a main component, and examples thereof include an aluminum alloy containing, for example, Si, Fe, Cu, Mn, Mg, Cr, Zn, Ti, and the like, in addition to aluminum. Here, the "main component" means an element of a highest content proportion (weight basis) among the elements contained in the alloy.

In particular, it is considered that in a case where the outer peripheral surface (that is, the surface on which the undercoating layer is directly provided) of the conductive substrate contains at least one selected from aluminum and copper, corrosion and formation of the oxide film are likely to occur due to the influence of the surface treatment agent contained in the undercoating layer, and the value of the current flowing from the undercoating layer to the conductive substrate is likely to be lowered. However, as described above, since the value of current is prevented from being lowered in the exemplary embodiment, the density unevenness of the image due to a partial decrease in the value of current is prevented from occurring.

The "conductive" means that a volume resistivity is less than $10^{13}$ Ωcm.

Examples of a shape of the conductive substrate include a cylindrical shape.

A thickness of the conductive substrate (a thickness) is, for example, from 0.2 mm to 1.5 mm, and is preferably from 0.4 mm to 1.2 mm, and more preferably from 0.4 mm to 0.8 mm.

It is considered that, in a case where the conductive substrate is thin, the image is likely to be affected when corrosion and formation of the oxide film occur on the outer peripheral surface of the conductive substrate. On the other hand, in the first aspect, as described above, corrosion and formation of an oxide film on the outer peripheral surface of the conductive substrate are prevented, thereby preventing the density unevenness of the image. Also, in the second aspect, as described above, the value of current flowing from the undercoating layer to the conductive substrate is prevented from being lowered, the density unevenness of the image due to the partial decrease in the value of current is prevented.

A diameter and an axial length of the conductive substrate are not particularly limited, and are values that vary depending on an application or the like. The diameter of the conductive substrate is, for example, from 20 mm to 100 mm, and the length of the conductive substrate in the axial direction is, for example, from 200 mm to 500 mm.

The conductive substrate is produced by a known forming processing such as drawing and extracting, drawing, impact pressing, ironing, and cutting. From the viewpoint of thinning and high hardness, the conductive substrate is preferably produced by impact pressing, and more preferably produced by impact pressing and subsequent ironing. That is, the conductive substrate is preferably an impact pressed product or an impact pressed product subjected to ironing.

Here, the impact pressing is a processing method in which a metal lump is disposed in a circular female mold and is formed into a hollow cylindrical body along a male mold by hitting the cylindrical male mold. After forming the hollow cylindrical body by impact pressing, an inner diameter, an outer diameter, a cylindricity, and roundness are adjusted by one time or plural times of ironing to obtain a conductive substrate. After the ironing, both ends of the cylindrical tube may be cut off and end face treatment may be performed.

In a case where the electrophotographic photoreceptor is used in a laser printer, the surface of the conductive substrate preferably roughened to have a center line average roughness Ra of 0.04 μm to 0.5 μm in order to prevent interference fringes which may be generated when emitting laser light. In a case of using non-interference light as a light source, although roughening for prevention of interference fringes is not particularly necessary, since the roughening prevents defects due to irregularities on the surface of the conductive substrate, roughening is suitable for longer life.

Examples of a surface-roughening method include wet honing performed by suspending an abrasive in water and spraying suspension on a support, centerless grinding performed by pressing the conductive substrate against a rotating grindstone and performing continuous grinding processing, and anodic oxidation.

Examples of the surface-roughening method also include a method in which a conductive or semi-conductive powder is dispersed in resin and by coating with the resultant, a layer is formed on the surface of the conductive substrate, so that surface-roughening is performed by particles dispersed in the layer without roughening the surface of the conductive substrate.

In the surface roughening treatment by anodic oxidation, an oxide film is formed on the surface of the conductive substrate by anodizing in an electrolyte solution using a conductive substrate made of metal (for example, aluminum) as an anode. Examples of the electrolyte solution include a sulfuric acid solution and an oxalic acid solution. However, a porous anodic oxide film formed by the anodic oxidation is chemically active in the state as it is, is likely to be stained, and exhibits a large change in resistance depending on the environment. In view of the above, the porous anodic oxide film is preferably subjected to a sealing treatment that fine pores of the oxide film are blocked by volume expansion due to hydration reaction in pressurized water vapor or boiling water (a metal salt such as nickel may be added) such that the porous anodic oxide film becomes a more stable hydrated oxide.

A thickness of the anodic oxide film is preferably, for example, from 0.3 μm to 15 μm. When the film thickness is within the above range, there is tendency that barrier properties against injection are exhibited, and there is tendency that rising of the residual potential due to repeated use is prevented.

The conductive substrate may also be subjected to a treatment with an acidic treatment solution or a boehmite treatment.

The treatment with the acidic treatment solution is carried out, for example, as follows. First, an acidic treatment liquid containing phosphoric acid, chromic acid, and hydrofluoric acid is prepared. A mixing ratio of the phosphoric acid, the chromic acid, and the hydrofluoric acid in the acidic treatment solution is, for example, from 10% by weight to 11% by weight of phosphoric acid, from 3% by weight to and 5% by weight of chromic acid, and from 0.5% by weight to 2% by weight, and a total concentration of these acids may be from 13.5% by weight to 18% by weight. A treatment temperature is preferably, for example, from 42° C. to 48° C. A film thickness of the coated film is preferably from 0.3 μm to 15 μm.

The boehmite treatment is carried out by, for example, immersing the conductive substrate in deionized water having a temperature of 90° C. to 100° C. for 5 minutes to 60 minutes, or contacting the conductive substrate to heated steam having a temperature of 90° C. to 120° C. for 5 minutes to 60 minutes. A film thickness of the coated film is preferably from 0.1 urn to 5 μm. The anodic oxidation may be further performed using an electrolyte solution having low film solubility such as adipic acid, boric acid, borate, phosphate, phthalate, maleate, benzoate, tartrate, and citrate.

Undercoating Layer

The undercoating layer is a layer provided in contact with the outer peripheral surface of the conductive substrate.

The undercoating layer contains at least inorganic particles surface-treated with a surface treatment agent, and may further contain other components (for example, a binder resin, an electron accepting compound, and inorganic particles non-surface-treated) as needed.

First, the inorganic particles surface-treated with the surface treatment agent will be described.

Examples of the inorganic particles include inorganic particles having a powder resistance volume resistivity) of $10^2$ Ωcm to $10^{11}$ Ωcm.

Among these, examples of the inorganic particles having the above resistance value may be metal oxide particles such as tin oxide particles, titanium oxide particles, zinc oxide particles, and zirconium oxide particles, and the zinc oxide particles are particularly preferable.

A volume average particle diameter of the inorganic particles is, for example, from 50 nm to 2,000 nm, preferably from 60 nm to 1,000 nm, more preferably from 60 nm to 200 nm, and still more preferably from 70 nm to 150 nm.

A specific surface area of the inorganic particles by a BET method is, for example, 10 $m^2/g$ or more, preferably from 10 $m^2/g$ to 200 $m^2/g$, and more preferably from 30 $m^2/g$ to 180 $m^2/g$.

Two or more kinds of the inorganic particles having different particle diameters may be used in combination.

The volume average particle diameter is measured using a laser diffraction type particle size distribution measuring apparatus (LA-700: manufactured by Horiba. Ltd.). As a measurement method, a sample (that is, inorganic panicles to be measured) in a dispersion state is adjusted to 2 g in terms of the solid content, and ion-exchanged water is added thereto to make 40 mL. This is added to a cuvette until an appropriate concentration is reached, and after standing for 2 minutes, measurement is performed. Particle diameters for respective obtained channels are accumulated from the smaller one in the average particle diameter basis, and a point where the cumulative 50% is reached is set as the volume average particle diameter.

In addition, the specific surface area of the inorganic particles is measured as follows. Specifically, the BET specific surface area is measured by a three point method using an SA3100 specific surface area measuring apparatus (manufactured by Beckman Coulter, Inc.). Specifically, 5 g of a sample (that is, inorganic particles to be measured) is put into a cuvette, is subjected to a degassing treatment at 60° C. for 120 minutes, and measured using a mixed gas of nitrogen and helium (volume ratio 30:70).

Examples of a surface treatment agent include a silane coupling agent, a titanate coupling agent, an aluminum coupling agent, and a surfactant. In particular, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-amino propylmethyldimethoxysilane, and N,N-bis(2-hydroxyethyl)-3-aminopropyltrieroxysilane, but are not limited thereto.

Two or more kinds of the silane coupling agents may be used in combination. For example, the silane coupling agent having an amino group and another silane coupling agent may be used in combination. Examples of other silane coupling agents include vinyltrimethoxysilane, vinyltriethoxysilane, 3-methacryloxypropyl-tris(2-methoxyethoxy) silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method with the surface treatment agent may be any method as long as it is a known method, and either a dry method or a wet method may be used.

An amount of the surface treatment agent for treatment is preferably, for example, from 0.5% by weight to 10% by weight with respect to the weight of the inorganic particles excluding the surface treatment agent.

A content of the inorganic particles surface-treated with the surface treatment agent is, for example, from 68% by weight to 85% by weight, preferably from 72% by weight to 83% by weight, more preferably from 75% by weight to 82% by weight, and still more preferably from 78% by weight to 80% by weight, with respect to the entire amount of the undercoating layer.

The undercoating layer may contain at least inorganic particles surface-treated with a surface treatment agent, and may further contain inorganic particles non-surface-treated with the surface treatment agent, as needed. The proportion of the inorganic particles surface-treated with the surface treatment agent is preferably 90% by weight or more, more preferably 92% by weight or more, and still more preferably 95% by weight or more, respect to the entire amount of the inorganic particles contained in the undercoating layer.

The undercoating layer preferably further contains a binder resin.

Examples of the binder resin useful for the undercoating layer include known polymer compounds such as acetal resins (such as polyvinyl butyral), polyvinyl alcohol resin, polyvinyl acetal resin, casein resin, polyamide resin, cellulose resin, gelatin, polyurethane resin, polyester resin, unsaturated polyester resin, methacrylic resin, acrylic resin, polyvinyl chloride resin, polyvinyl acetate resin, vinyl chloride-vinyl acetate-maleic anhydride resin, silicone resin, silicone-alkyd resin, urea resin, phenol resin, phenol-formaldehyde resin, melamine resin, urethane resin, alkyd resin, and epoxy resin; a zirconium chelate compound; a titanium chelate compound; an aluminum chelate compound; a titanium alkoxide compound; an organic titanium compound; and a known material such as a silane coupling agent.

Examples of the binder resin useful for the undercoating layer also include a charge transporting resin having a charge transporting group and conductive resin (such as polyaniline).

Among these, as the binder resin useful for the undercoating layer, a resin which is insoluble in a coating solvent of the upper layer. In particular, a resin obtained by the reaction between a curing agent and at least one selected from the group consisting of thermosetting resin such as urea resin, phenol resin, phenol-formaldehyde resin, melamine resin, urethane resin, unsaturated polyester resin, alkyd resin, and epoxy resin; polyamide resin, polyester resin, polyether resin, methacrylic resin, acrylic resin, polyvinyl alcohol resin, and polyvinyl acetal resin is preferable.

In a case where two or more of these binder resins are used in combination, a mixing ratio thereof is set as needed.

Here, the undercoating layer may contain an electron accepting compound (acceptor compound) together with the inorganic particles, from the viewpoint of improving long-term stability of electric characteristics and carrier blocking property.

Examples of the electron accepting compound include electron transport substances such as: quinone compounds such as chloranil and bromoanil; a tetracyanoquinodimethane compound; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole; a xanthone compound; a thiophene compound; and diphenoquinone compounds such as 3,3',5,5'-tetra-t-butyldiphenoquinone.

In particular, as the electron accepting compound, a compound having an anthraquinone structure is preferable. As the compound having an anthraquinone structure include a hydroxyanthraquinone compound, an aminoanthraquinone compound; and an aminohydroxyanthraquinone compound are preferable, and specifically, for example, anthraquinone, alizarin, quinizarin, anthrarufine, purpurin, and the like are preferable.

The electron accepting compound may be contained at a state dispersed in the undercoating layer together with the inorganic particles or may be contained at a state of attaching to the surfaces of the inorganic particles.

Examples of a method of attaching the electron accepting compound to the surfaces of the inorganic particles include a dry method or a wet method.

The dry method is, for example, a method in which while stirring inorganic particles with a mixer or the like having a large shear force, an electron accepting compound is dropped directly or by being dissolved in an organic solvent, and sprayed together with dry air or nitrogen gas to attach the electron accepting compound to the surfaces of the inorganic particles. When dropping or spraying the electron accepting compound, the dropping or spraying the electron accepting compound may be carried out at a temperature equal to or lower than a boiling point of the solvent. After dropping or spraying the electron accepting compound, baking may further be carried out at 100° C. or higher. Baking is not particularly limited as long as the baking is carried out at a temperature and time at which electrophotographic characteristics are obtained.

The wet method is, for example, a method in which an electron accepting compound is added while dispersing inorganic particles in a solvent by stirring, ultrasonic wave, sand mill, attritor, ball mill, or the like, and is stirred or dispersed, and then the solvent is removed to attach the electron accepting compound to the surfaces of the inorganic particles. In the solvent removal method, the solvent is removed, for example, by filtration or distillation. After removing the solvent, baking may further be carried out at 100° C. or higher. Baking is not particularly limited as long as the baking is carried out at a temperature and time at which electrophotographic characteristics are obtained. In the wet method, moisture contained in the inorganic particles may be removed before adding the electron accepting compound. Examples of this method include a method of removing the moisture while stirring and heating in a solvent, and a method of removing the moisture by azeotropic distillation with a solvent.

The attachment of the electron accepting compound may be carried out before or after the inorganic particles are subjected to the surface treatment with the surface treatment agent. Also, the attachment of the electron accepting compound and the surface treatment with the surface treatment agent may be carried out at the same time.

A content of the electron accepting compound may be, for example, from 0.01% by weight to 20% by weight, and is preferably from 0.01% by weight to 10% by weight in the inorganic particles.

The undercoating layer may contain various additives for improving electrical properties, environmental stability, and image quality.

Examples of the additives include known materials such as an electron transporting pigment such as polycondensation type and azo type, a zirconium chelate compound, a titanium chelate compound, an aluminum chelate compound, a titanium alkoxide compound, an organic titanium compound, and a silane coupling agent. The silane coupling agent is useful for a surface treatment of the inorganic particles as described above, but may be further added to the undercoating layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris(ethyl acetoacetate).

These additives may be used alone, or as a mixture or polycondensate of a plurality of compounds.

The undercoating layer may have a Vickers hardness of 35 or higher.

In order to prevent a moire fringe from occurring, surface roughness (ten-point average roughness) of the undercoating layer may be adjusted from 1/(4n) (n is a refractive index of an upper layer) of the exposure laser wavelength λ to ½ thereof.

In order to adjust the surface roughness, resin particles or the like may be added to the undercoating layer. Examples of the resin particles include silicone resin particles and crosslinked polymethylmethacrylate resin particles. Further, in order to adjust the surface roughness, the surface of the undercoating layer may be polished. Examples of a polishing method include buffing, sandblasting treatment, wet honing, and grinding treatment.

As described above, the undercoating layer is provided in contact with the outer peripheral surface of the conductive substrate.

In the first aspect, with respect to the outer peripheral surface of the conductive substrate, the proportion (that is, the inorganic particle contact proportion) of the area being in contact with the inorganic particles contained in the undercoating layer is from 82% to 91%, preferably from 84% to 89%, and more preferably from 85% to 88%. Also, in the second aspect, the inorganic particle contact proportion is preferably from 82% to 91%, more preferably from 84% to 89%, and still more preferably from 85% to 88%.

When the inorganic particle contact proportion is in the above range, an image preventing density unevenness is obtained, as compared with a case where the inorganic particle contact proportion is less than the range, there are advantages that the residual potential is reduced and the life is extended.

A method of controlling the inorganic particle contact proportion to the range is not particularly limited, and examples thereof include a method of adjusting rheology (for example, elastic recovery amount) of an undercoating layer-forming coating liquid to be used in formation of the undercoating layer to be described later.

Formation of the undercoating layer is not particularly limited and a known forming method is used. For example, a coating film is formed with an undercoating layer-forming coating liquid obtained by adding the above components to a solvent, and the coating film is dried, by heating as needed, to form an undercoating layer.

Examples of the solvent for preparing the undercoating layer-forming coating liquid include known organic solvents such as alcohol solvent, aromatic hydrocarbon solvent, halogenated hydrocarbon solvent, ketone solvent, ketone alcohol solvent, ether solvent, and ester solvent.

Specific examples of these solvents include usual organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method of dispersing inorganic particles in preparing the undercoating layer-forming coating liquid include known methods with a roll mill, a ball a vibration ball mill, an attritor, a sand mill, a colloid mill, a paint shaker or the like.

As described above, the inorganic particle contact proportion of the formed undercoating layer may be controlled by adjusting the rheology (for example, the elastic recovery amount) of the undercoating layer-forming coating liquid.

The elastic recovery amount of the undercoating layer-forming coating liquid is, for example, 0.30 Pa·sec or more and less than 0.90 Pa·sec, preferably from 0.50 Pa·sec to 0.85 Pa·sec, and more preferably from 0.55 Pa·sec to 0.80 Pa·sec.

Here, the "elastic recovery amount" is the amount of change in shear viscosity due to application of a shear stress with shear rate of 0.1 sec' after applying a shear stress with shear rate of 1,000 sec' to the undercoating layer-forming coating liquid, and is one of indicators to evaluate thixotropy of a liquid.

Also, the "elastic recovery amount" is measured as follows. Specifically, 2 mL of the undercoating layer-forming coating liquid is set in a viscoelasticity measuring apparatus (ANTON PARR, model number: MCR302), and a shear stress with a shear rate of 1,000 $sec^{-1}$ is applied using a cone plate (ANTON PAAR, model number: CP50-1 (diameter: 25 mm, cone angle: 1.0°)), and then a shear stress with a shear rate of 0.1 $sec^{-1}$ is applied. The amount of change in shear viscosity at that time is defined as the elastic recovery amount.

A method of controlling the elastic recovery amount of the undercoating layer-forming coating liquid to the range is not particularly limited, and examples thereof include a method in which components contained in the undercoating layer-forming coating liquid are mixed, subjected to a first dispersing step, and then subjected to a circulation step, thereby controlling the elastic recovery amount of the undercoating layer-forming coating liquid to the range.

Examples of the dispersing method in the first dispersing step include a method with a sand mill. In a case where the sand mill is used in the first dispersing step, examples of the beads for the sand mill include glass beads each having a diameter of 0.5 mm to 4 mm. In addition, the dispersing time in the first dispersing step is, for example, from 4 hours to 10 hours, and preferably from 5 hours to 7 hours.

The elastic recovery amount of the undercoating layer-forming coating liquid (that is, first dispersion) undergone the first dispersing step is, for example, 0.08 Pa·sec or more and less than 0.30 Pa·sec.

Examples of a circulation method in the circulation step include a method using a circulation unit including a stirring tank, a liquid feed pump, a filter, and a circulation path connecting the stirring tank, the liquid feed pump, and filter. In the circulation step, for example, the undercoating layer-forming coating liquid undergone the first dispersing step is stirred in the stirring tank. Then, a part of the undercoating layer-forming coating liquid in the stirring tank is sent to the circulation path by the liquid feed pump, passes through the filter, and returned to the stirring tank. Thus, the undercoating layer-forming coating liquid is circulated.

The liquid feeding amount of the liquid feed pump is for example, from 50 mL/min to 1,000 ml/min, preferably from 100 mL min to 500 mL/min, and more preferably from 150 mL/min to 400 mL/min.

A sieve of the filter is, for example, from 0.02 mm to 005 mm, and is preferably from 0.022 mm to 0.04 mm, and more preferably from 0.025 mm to 0.03 mm.

The circulation time in the circulation step is, for example, from 20 hours to 60 hours, preferably from 30 hours to 58 hours, and more preferably from 48 hours to 55 hours.

The reason why, as above, when using the undercoating layer-forming coating liquid undergone the first dispersing step and the circulation step, the undercoating layer having the inorganic particle contact proportion within the range is formed is not clear, but it is presumed as follows. Specifically, in the undercoating layer-forming coating liquid undergone the first dispersing step and the circulation step, the inorganic particles are moderately aggregated in the coating liquid, as compared with a undercoating layer-forming coating liquid undergone the first dispersing step and a secondary dispersing step. Therefore, it is presumed that the proportion of the inorganic particles being in contact with the conductive substrate is reduced, and the undercoating layer having the inorganic particle contact proportion within the range is formed, in addition, it is presumed that, since in the undercoating layer-forming coating liquid that has undergone the first dispersing step and the circulation step, the inorganic particles are less aggregated, as compared with the undercoating layer-forming coating liquid undergone only the first dispersing step, the undercoating layer having the inorganic particle contact proportion within the range is formed.

Examples of a method for applying the undercoating layer-forming coating liquid onto the conductive substrate include normal methods such as a blade coating method, a wire bar coating method, a spray coating method, a dipping coating method, a bead coating method, an air knife coating method, and a curtain coating method.

The film thickness of the undercoating layer is, for example, from 3 μm to 50 μm, and from the viewpoint of preventing a residual potential from rising, is preferably from 3 μm to 30 μm, and more preferably from 3 μm to 20 μm.

The film thickness of the undercoating layer is measured using an eddy current film thickness meter CTR-1500E manufactured by Sanko Denshi Co., Ltd.

From the viewpoint of conductivity, the film thickness of the undercoating layer is preferably 10 to 30 times, more preferably 12 to 28 times, and more preferably 15 to 25 times the thickness of the conductive substrate.

In the first aspect, the current reduction rate due to use is preferably 20% or less, more preferably 10% or less, and still more preferably 5% or less. Also, in the second aspect, the current reduction rate due to use is 20% or less, preferably 10% or less, and more preferably 5% or less.

When the current reduction rate due to use is in the range, an image in which density unevenness is prevented is obtained, as compared with a case where the current reduction rate due to use exceeds the range.

A method of controlling the current reduction rate due to use to the range is not particularly limited, and examples thereof include a method of adjusting the inorganic particle contact proportion to the range.

Intermediate Layer

Although not shown, an intermediate layer may further be provided between the undercoating layer and the photosensitive layer.

The intermediate layer is, for example, a layer containing a resin. Examples of the resin useful for the intermediate layer include polymer compounds such as acetal resin such as polyvinyl butyral), polyvinyl alcohol resin, polyvinyl acetal resin, casein resin, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, and melamine resin.

The intermediate layer may be a layer containing an organometallic compound. Examples of the organometallic compound useful for the intermediate layer include an organometallic compound containing a metal atom such as zirconium, titanium, aluminum, manganese, and silicon.

These compounds useful for the intermediate layer may be used alone, or as a mixture or a polycondensate of a plurality of compounds.

Among these, the intermediate layer is preferably a layer containing the organometallic compound having a zirconium atom or a silicon atom.

Formation of the intermediate layer is not particularly limited and a known forming method is used. For example, with an intermediate layer-forming coating liquid obtained by adding the above components to a solvent, a coating film is formed, and dried, by heating as needed, to form an undercoating layer.

As a coating method by which the intermediate layer is formed, normal methods such as a dipping coating method, an extrusion coating method, a wire bar coating method, a spray coating method, a blade coating method, a knife coating method, and a curtain coating method, are used.

A film thickness of the intermediate layer is preferably set to, for example, 0.1 μm to 3 μm. The intermediate layer may also be used as the undercoating layer, Charge Generation Layer The charge generation layer is, for example, a layer containing a charge generation material and a binder resin. Further, the charge generation layer may be a layer obtained by depositing a charge generation material. The deposition layer of the charge generation material is suitable for a case of using an incoherent light source such as a light emitting diode (LED) or an organic electro-luminescence (EL) image array.

Examples of the charge generation material include azo pigments such as bisazo and trisazo; a condensed ring aromatic pigment such as dibromoanthanthrone; a perylene pigment; a pyrrolopyrrole pigment; a phthalocyanine pigment; zinc oxide; and trigonal selenium.

Among these materials, in order to cope with laser exposure in the near infrared region, it is preferable to use a metal phthalocyanine pigment or a metal-free phthalocyanine pigment, as the charge generation material. Specifically, hydroxygallium phthalocyanine; chlorogallium phthalocyanine; dichlorotin phthalocyanine; and titanyl phthalocyanine are more preferable.

On the other hand, in order to cope with laser exposure in the near ultraviolet region, as the charge generation material; a condensed aromatic pigment such as dibromoanthanthrone; a thioindigo pigment; a porphyrazine compound; zinc oxide; trigonal selenium; a disazo compound; and a bisazo pigment are preferable.

Also, in a case of using an incoherent light source having an emission center wavelength of 450 nm to 780 μm, such as an LED or an organic EL image array; the above charge generation material may be used. However, from the viewpoint of resolution, when using a thin film of 20 μm or less as the photosensitive layer, the electric field intensity in the photosensitive layer increases, and charge reduction due to charge injection from the substrate is likely to occur so that image defect, referred to as a so-called black spot, is likely to occur. The tendency is remarkable when using a charge generation material which is likely to cause dark current in a p-type semiconductor, such as trigonal selenium or a phthalocyanine pigment.

On the contrary, when using an n-type semiconductor such as a condensed ring aromatic pigment, a perylene pigment, and an azo pigment, as the charge generation material, it is unlikely to generate a dark current and, even with respect to a thin film, the image defect called a black spot is prevented. Examples of the n-type charge generation material include compounds (CG-1) to (CG-27) described in paragraphs [0288] to [0291] of JP-A-2012-155282, but are not limited thereto.

n-Type is determined depending on a polarity of flowing photocurrent by using a normally used time-of-flight method, and a type in which the photocurrent is easy to flow using electrons rather than holes as carriers is determined as the n-type.

The binder resin useful for the charge generation layer is selected from a wide range of insulating resins. In addition, the binder resin may be selected from organic photoconductive polymers such as poly-N-vinyl carbazole, polyvinyl anthracene, polyvinylpyrene, and polysilane.

Examples of the binder resin include polyvinyl butyral resin, polyarylate resin (such as polycondensate of bisphenols and aromatic dicarboxylic acid), polycarbonate resin, polyester resin, phenoxy resin, vinyl chloride-vinyl acetate copolymer, polyimide resin, acrylic resin, polyacrylamide resin, polyvinyl pyridine resin, cellulose resin, urethane resin, epoxy resin, casein, polyvinyl alcohol resin, and polyvinyl pyrrolidone resin. Here, "conductive" means that the volume resistivity is $10^{13}$ Ωcm or more.

One kind of these binder resins is used alone or two or more kinds thereof are used in combination.

A mixing ratio of the charge generation material and the binder resin is preferably from 10:1 to 1:10 in terms of weight ratio.

The charge generation layer may also contain other known additives.

Formation of the charge generation layer is not particularly limited and a known forming method is used. For example, with a charge generation layer-forming coating liquid obtained by adding the above components to a solvent, a coating film is formed, and dried, by heating as needed, to form a charge generation layer. The formation of the charge generation layer may be carried out by vapor deposition of the charge generation material. Formation of the charge generation layer by the vapor deposition is particularly suitable for a case of using a condensed ring aromatic pigment or a perylene pigment as the charge generation material.

Examples of a solvent for preparing the charge generation layer-forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. One kind of the solvents is used alone and two or more kinds thereof are used in combination.

In a method for dispersing panicles for example, charge generation material) in the charge generation layer-forming coating liquid, for example, a media dispersing machine such as a ball mill, a vibration ball mill, an attritor, a sand mill, and a horizontal sand mill or a media-less dispersing machine such as a stirrer, an ultrasonic dispersing machine, a roll mill, and a high-pressure homogenizer is used. Examples of the high-pressure homogenizer include a collision type in which dispersing is performed by a liquid-liquid collision or a liquid-wall collision in a high pressure state, or a penetration type in which dispersing is performed by penetrating a fine flow path in a high pressure state.

When dispersing is performed, it is effective to set the average particle diameter of the charge generation material in the charge generation layer-forming coating liquid to 0.5 μm or less, preferably 0.3 μm or less, and more preferably 0.15 μm or less.

Examples of a method for coating the undercoating layer (or an intermediate layer) with the charge generation layer-forming coating liquid include normal methods such as a blade coating method, a wire bar coating method, a spray coating method, a dipping coating method, a bead coating method, an air knife coating method, and a curtain coating method.

A film thickness of the charge generation layer is, for example, set preferably from 0.1 μm to 5.0 μm, and more preferably from 0.2 μm to 2.0 μm.

Charge Transport Layer

The charge transport layer is, for example, a layer containing a charge transporting material and a binder resin. The charge transport layer may be a layer containing a polymeric charge transporting material.

Examples of the charge transporting material include electron transport compounds such as: quinone compounds such as p-benzoquinone, chloranil, bromanil, and anthraquinone; a tetracyanoquinoditnethane compound; a fluorenone compound such as 2,4,7-trinitrofluorenone; a xanthone compound; a benzophenone compound; a cyanovinyl compound; and an ethylene compound. Examples of the charge transporting material also include hole transporting compounds such as a triarylamine compound, a benzidine compound, an arylalkane compound, an aryl-substituted ethylene compound, a stilbene compound, an anthracene compound, and a hydrazone compound. These charge transporting materials may be used alone or in combination of two or more thereof, but are not limited thereto.

As the charge transporting material, from the viewpoint of charge mobility, a triarylamine derivative represented by the following Formula (a-1) and a benzidine derivative represented by the following Formula (a-2) are preferable.

(a-1)

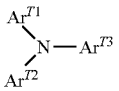

In Formula (a-1), $Ar^{T1}$, $Ar^{T2}$, and $Ar^{T3}$ each independently represent a substituted or unsubstituted amyl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent which each of the above groups may have include a halogen atom, an alkyl group having 1 to 5 carbon atoms, and an alkoxy group having 1 to 0.5 carbon atoms. Examples of the substituent which each of the above groups also may have include a substituted amino group substituted with an alkyl group having 1 to 3 carbon atoms.

(a-2)

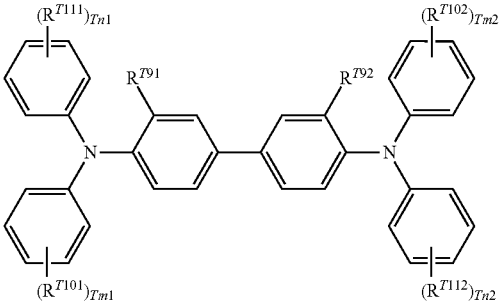

In Formula (a-2) $R^{T91}$, and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group having 1 or 2 carbon atoms substituted with an alkyl group, a substituted or unsubstituted aryl group, $—C(R^{T12})=C(R^{T13})(R^{T14})$, or $—CH=CH—CH=C(R^{T15})(R^{T16})$. $R^{R12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

Examples of the substituent which each of the above groups may have include a halogen atom, an alkyl group having 1 to 5 carbon atoms, and an alkoxy group having 1 to 5 carbon atoms. Examples of the substituent of each of the above groups also include a substituted amino group substituted with an alkyl group having 1 to 3 carbon atoms.

Among the triarylamine derivative represented by Formula (a-1) and the benzidine derivative represented by Formula (a-2), from the viewpoint of charge mobility, a triarylamine derivative having "$—C_6H_4—CH=CH—CH=C(R^{T7})(R^{T8})$" and a benzidine derivative having "$—CH=CH—CH=C(R^{T15})(R^{T16})$" are particularly preferable.

As the polymeric charge transporting material, known materials having charge transporting ability, such as poly-N-vinylcarbazole and polysilane are used. In particular, polyester-based polymeric charge transporting materials are preferable. The polymer charge transporting material may be used alone or may be used in combination with the binder resin.

Examples of the binder resin useful for the charge transport layer include polycarbonate resin, polyester resin, polyarylate resin, methacrylic resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone alkyd resin, phenol-formaldehyde resin, styrene-alkyd resin, poly-N-vinylcarbazole, and polysilane. Among these resins, as the binder resin, the polycarbonate resin or the polyarylate resin is preferable. One kind of these binder resins is used alone or two or more kinds thereof are used.

A mixing ratio of the charge transporting material and the binder resin is preferably from 10:1 to 1:5 in terms of weight ratio.

The charge transport layer may also contain other known additives.

Formation of the charge transport layer is not particularly limited and a known forming method is used. For example, with a charge transport layer-forming coating liquid obtained by adding the above components to a solvent, a coating film is formed, and dried, by heating as needed, to form a charge transport layer.

Examples of a solvent for preparing the charge transport layer-forming coating liquid include usual organic solvents such as aromatic hydrocarbons such as benzene, toluene, xylene, and chlorobenzene ketones such as acetone and 2-butanone; halogenated aliphatic hydrocarbons such as methylene chloride, chloroform, and ethylene chloride; and cyclic or linear ethers such as tetrahydrofuran and ethyl ether. One kind of the solvents is used alone and two or more kinds thereof are used in combination.

Examples of an applying method useful when applying the charge transport layer-forming coating liquid onto the charge generation layer include normal methods such as a blade coating method, a wire bar coating method, a spray coating method, a dipping coating method, a bead coating method, an air knife coating method, and a curtain coating method.

A film thickness of the charge transport layer is, for example, set preferably from 5 μm to 50 μm, and more preferably from 10 μm to 30 μm.

Protective Layer

The protective layer is provided on the photosensitive layer as needed. The protective layer is provided, for example, to prevent the photosensitive layer from chemically changing at the time of charging and to further improve the mechanical strength of the photosensitive layer.

Therefore, a layer configured by a cured fill. (crosslinked film) may be applied as the protective layer. Examples of the layer include a layer shown in the following 1) or 2).

1) A layer configured by a cured film of a composition containing a reactive group-containing charge transporting material having a reactive group and a charge transporting skeleton in the same molecule (that is, a layer containing a polymer or crosslinked member of the reactive group-containing charge transporting material)

2) A layer configured by a cured film of a composition containing a non-reactive charge transporting material and a reactive group-containing non-charge transporting material having a reactive group without having a charge transporting skeleton (that is, a layer containing a non-reactive charge transporting material and a polymer or a crosslinked member of the reactive group-containing non-charge transporting material)

Examples of the reactive group of the reactive group-containing charge transporting material include known reactive groups such as a chain polymerizable group, an epoxy group, —OH, —OR (where R represents an alkyl group). —$NH_2$, —SH, —COOH, and —$SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain polymerizable group is not particularly limited as long as it is a functional group capable of radical polymerization, and is, for example, a functional group having a group containing at least a carbon double bond. Specific examples thereof include a group containing at least one selected from a vinyl group, a vinyl ether group, a vinyl thioether group, a vinyl phenyl group, an acryloyl group, a methacryloyl group, and derivatives thereof. Among these, from the viewpoint of excellent reactivity, as the chain polymerizable group, a group containing at least one selected from the vinyl group, the vinylphenyl group, the acryloyl group, the methacryloyl group, and derivatives thereof is preferable.

The charge transporting skeleton of the reactive group-containing charge transporting material is not particularly limited as long as it is a known structure in an electrophotographic photoreceptor, and examples thereof include skeleton derived from a nitrogen-containing hole transport compound such as a triarylamine compound, a benzidine compound, and a hydrazone compound, in which the skeleton has a structure conjugated with a nitrogen atom. Among these, a triarylamine skeleton is preferable.

The reactive group-containing charge transporting material having a reactive group and a charge transporting skeleton, the non-reactive charge transporting material, and the reactive group-containing non-charge transporting material may be selected from known materials.

The protective layer may also contain other known additives.

Formation of the protective layer is not particularly limited and a known forming method is used. For example, with a protective layer-forming coating liquid obtained by adding the above components to a solvent, a coating film is formed; and dried and, as needed, subjected to a curing treatment such as heating, to form a protective layer.

Examples of the solvent for preparing the protective layer-forming coating liquid include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. One kind of the solvents is used alone and two or more kinds thereof are used in combination.

The protective layer-forming coating liquid may be a solventless coating liquid.

Examples of a method of applying the protective layer-forming coating liquid onto photosensitive layer (for example, charge transport layers include normal methods such as a dipping coating method, an extrusion coating method, a wire bar coating method, a spray coating method, a blade coating method, a knife coating method, and a curtain coating method.

A film thickness of the protective layer is, for example, set preferably from 1 μm to 20 μm, and more preferably from 2 μm to 10 μm.

Hereinafter, a singlelayer type photosensitive layer 6 of the electrophotographic photoreceptor 7C shown in FIG. 2 will be described. Descriptions will be given without reference numerals in some cases.

Singlelayer Type Photosensitive Layer

The singlelayer type photosensitive layer (charge generation/transport layer) is, for example, a layer containing a charge generation material and a charge transporting material, and further containing a binder resin and other known additives, as needed. These materials are the same as those described for the charge generation layer and the charge transport layer.

Then, a content of the charge generation material in the singlelayer type photosensitive layer may be from 0.1% by weight to 10% by weight, and is preferably from 0.8% by weight to 5°/h by weight, with respect to the total solid content. In addition, a content of the charge transporting material in the singlelayer type photosensitive layer may be from 5% by weight to 50% by weight, with respect to the total solid content.

The method of forming the singlelayer type photosensitive layer is the same as the method of forming the charge generation layer and the charge transport layer.

A film thickness of the singlelayer type photosensitive layer may be, for example, from 5 μm to 50 μm, and is preferably from 10 μm to 40 μm Image Forming Apparatus and Process Cartridge An image forming apparatus according to the exemplary embodiment includes: an electrophotographic photoreceptor; a charging unit that charges a surface of the electrophotographic photoreceptor; an electrostatic latent image forming unit that forms an electrostatic latent image on the charged surface of the electrophotographic photoreceptor; a developing unit that develops the electrostatic latent image formed on the surface of the electrophotographic photoreceptor with a developer including toner to form a toner image; and a transfer unit that transfers the toner image onto a surface of a recording medium. As the electrophotographic photoreceptor, the electrophotographic photoreceptor according to the exemplary embodiment is adopted.

As the image forming apparatus according to the exemplary embodiment, known image forming apparatuses are adopted. Examples thereof include an apparatus including fixing unit that fixes a toner image transferred on a surface of a recording medium; a direct transfer type apparatus that directly transfers a toner image formed on a surface of an electrophotographic photoreceptor to a recording medium; an intermediate transfer type apparatus that firstly transfers a toner image formed on a surface of an electrophotographic photoreceptor to a surface of an intermediate transfer member and secondarily transfers the toner image transferred to the surface of the intermediate transfer member onto a surface of a recording medium; an apparatus including a cleaning unit that cleans a surface of the electrophotographic photoreceptor after the transfer of the toner image and before charging; an apparatus including an erasing unit that irradiates a surface of the electrophotographic photoreceptor after the transfer of a toner image and before charging, with antistatic electricity to erase electricity; and an apparatus including an electrophotographic photoreceptor heating unit that raise a temperature of an electrophotographic photoreceptor and reduces a relative temperature.

In a case of the intermediate transfer type apparatus, the transfer unit adopts, for example, a configuration including an intermediate transfer member in which a toner image is transferred on a surface thereof, a first transfer unit that firstly transfers the toner image formed on the surface of the electrophotographic photoreceptor to a surface of the intermediate transfer member, and a second transfer unit that secondarily transfers the toner image transferred to the surface of the intermediate transfer member to a surface of a recording medium.

The image forming apparatus according to the exemplary embodiment may be any of a dry developing type image forming apparatus or a wet developing type (a developing type using a liquid developer) image forming apparatus.

In the image forming apparatus according to the exemplary embodiment, for example, a portion having an electrophotographic photoreceptor may have a cartridge structure (process cartridge) which is detachable from the image forming apparatus. As the process cartridge, for example, a process cartridge including the electrophotographic photoreceptor according to the exemplary embodiment is suitably used. In the process cartridge may further include, for example, at least one selected from the group consisting of a charging unit, an electrostatic latent image forming unit, a developing unit, and a transfer unit, in addition to the electrophotographic photoreceptor.

Hereinafter, an example of the image forming apparatus according to the exemplary embodiment will be shown, but the image forming apparatus is not limited thereto. A major part shown in the figure will be described, and descriptions for the other parts will be omitted.

Figure 3:
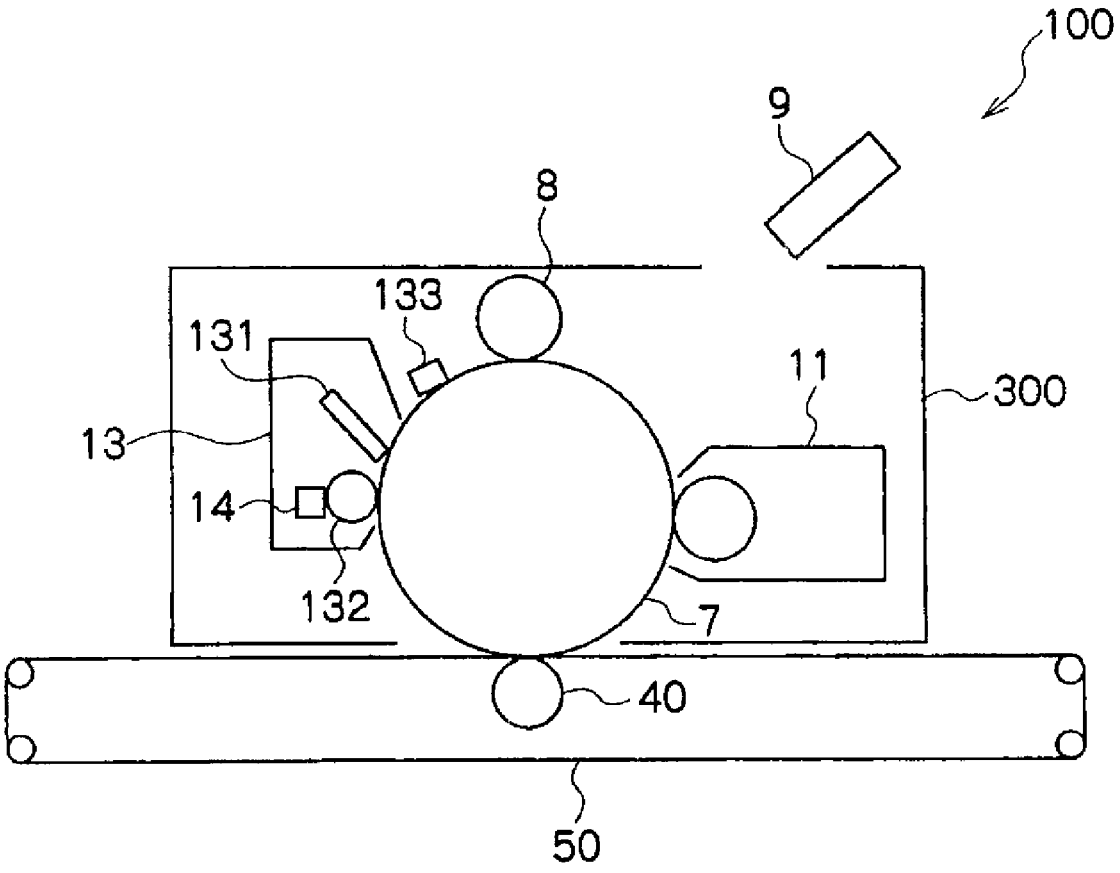
FIG. 3 is a schematic sectional diagram illustrating an example of an image forming apparatus according to the exemplary embodiment.

FIG. 3 is a schematic configuration diagram illustrating an example of the image forming apparatus according to the exemplary embodiment.

As shown in FIG. 3, the image forming apparatus 100 according to the exemplary embodiment includes a process cartridge 300 having an electrophotographic photoreceptor 7, an exposure unit 9 (an example of an electrostatic latent image forming unit), a transfer unit 40 (first transfer unit), and an intermediate transfer member 50. In the image forming apparatus 100, the exposure unit 9 is disposed at a position at which the electrophotographic photoreceptor 7 may be exposed from an opening of the process cartridge 300, the transfer unit 40 is disposed at a position facing the electrophotographic photoreceptor 7 via the intermediate transfer member 50, and the intermediate transfer member 50 is disposed so that a part thereof is in contact with the electrophotographic photoreceptor 7. Although not shown, the image forming apparatus 100 further includes a secondary transfer unit that transfers the toner image transferred to the intermediate transfer member 50 to a recording medium (for example, paper). The intermediate transfer member 50, the transfer unit 40 (first transfer unit), and the secondary transfer unit (not shown) correspond to examples of the transfer unit.

The process cartridge 300 in FIG. 3 includes the electrophotographic photoreceptor 7, a charging unit 8 (an example of the charging unit), a developing unit 11 (an example of the developing unit), and a cleaning unit 13 (an example of the cleaning unit), which are in a housing and are integrally supported. The cleaning unit 13 has a cleaning blade (an example of a cleaning member) 131. The cleaning blade 131 is disposed so as to contact with a surface of the electrophotographic photoreceptor 7. The cleaning member may be a conductive or insulating fibrous member, instead of an aspect of the cleaning blade 131. The conductive or insulating fibrous member may be used alone or in combination with the cleaning blade 131.

In FIG. 3, as the image forming apparatus, an example of including a fibrous member 132 (roll-shaped) that supplies a lubricant 14 to the surface of the electrophotographic photoreceptor 7 and a fibrous member 133 (flat brush shaped) that assists cleaning is shown, but these are disposed as needed.

Hereinafter, a configuration of the image forming apparatus according to the exemplary embodiment will be described.

Charging Unit

As the charging unit 8, for example, a contact type charging member using a conductive or semiconductive charging roller, a charging brush, a charging film, a charging rubber blade, a charging tube, or the like is used. In addition, a non-contact type roller charging member, a charging member known as it is such as a scorotron charging member or a corotron charging member using corona discharge, or the like is also used.

Exposure Unit

Examples of the exposure unit 9 include an optical system unit the exposes the surface of the electrophotographic photoreceptor 7 to light such as semiconductor laser light, LED light, liquid crystal shutter light according to an image data. A wavelength of the light source is within a spectral sensitivity range of the electrophotographic photoreceptor. As a wavelength of the semiconductor laser, near infrared having an emission wavelength near 780 nm is mostly used. However, the wavelength is not limited thereto, and an emission wavelength laser of 600 nm band or a laser having an emission wavelength of 400 nm to 450 nm as blue laser may also be used. In addition, a surface emitting type laser light source capable of outputting multiple beams is also effective for forming a color image.

Developing Unit

Examples of the developing unit 11 include a general developing unit that develops an image by contacting or non-contacting with a developer. The developing unit 11 is not particularly limited as long as it has the above-described function, and is selected according to the purpose. Examples thereof include a known developing machine having a function of attaching a single-component developer or a two-component developer to the electrophotographic photoreceptor 7 using a brush, a roller, or the like. Among the examples, it is preferable to use a developing roller holding developer on a surface thereof.

The developer useful for the developing unit 11 may be a single-component developer of toner alone or a two-component developer including toner and a carrier. In addition, the developer may be magnetic or nonmagnetic. Known developers are adopted to these developers.

Cleaning Unit

As the cleaning unit 13, a cleaning blade type unit including a cleaning blade 131 is used.

In addition to the cleaning blade type, a fur brush cleaning type and a development simultaneous cleaning type may be adopted.

Transfer Unit

Examples of the transfer unit 40 include a contact type transfer charging member using a belt, a roller, a film, a rubber blade, or the like and a transfer charging member known as it is such as a scorotron transfer charging member or a corotron transfer charging member using corona discharge.

Intermediate Transfer Member

As the intermediate transfer member 50, a belt-shaped member (intermediate transfer belt) containing polyimide, polyamideimide, polycarbonate, polyarylate, polyester, rubber, or the like to which seiniconductivity is imparted is used. In addition, as a form of the intermediate transfer member, a drum-shaped member may be used in addition to the belt shape.

Figure 4:
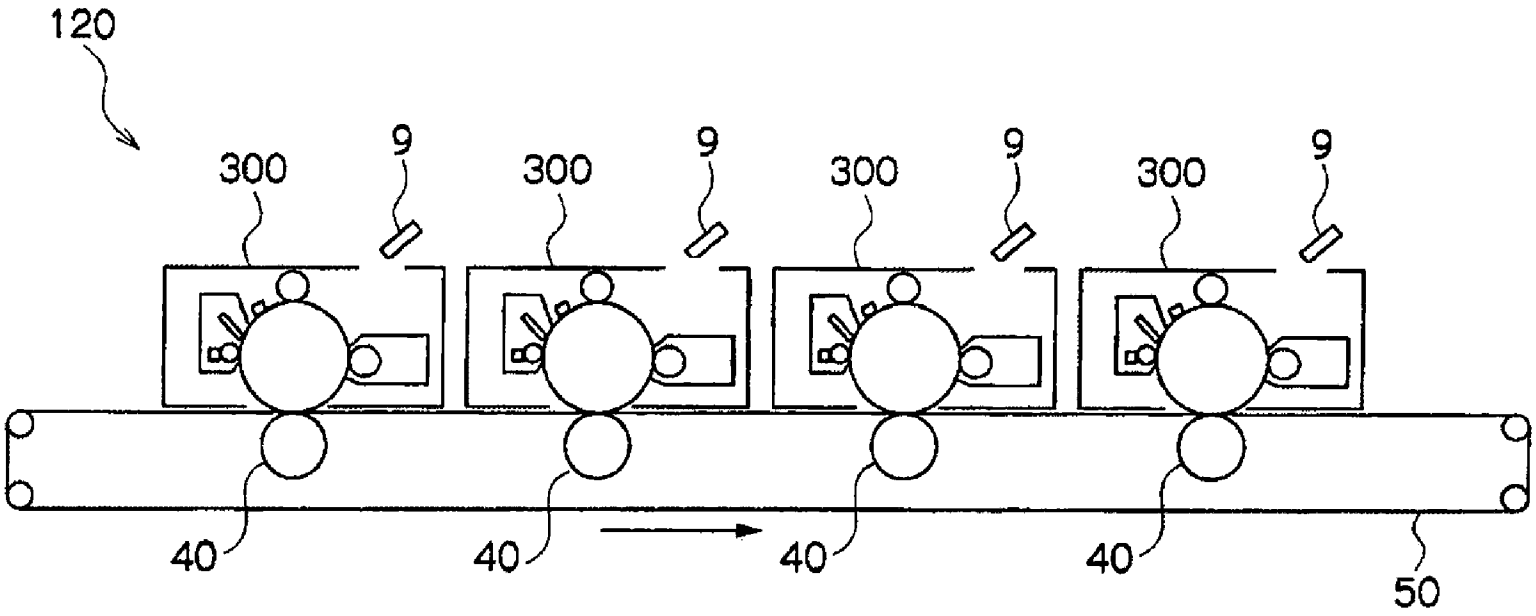
FIG. 4 is a schematic perspective diagram illustrating another example of the image forming apparatus according to the exemplary embodiment.

FIG. 4 is a schematic configuration diagram illustrating another example of the image forming apparatus according to the exemplary embodiment.

An image forming apparatus 120 shown in FIG. 4 is a tandem multicolor image forming apparatus on which four process cartridges 300 are mounted. The image forming apparatus 120 has a configuration in which four process cartridges 300 are arranged in parallel on the intermediate transfer member 50 and one electrophotographic photoreceptor is used for each color. The image forming apparatus 120 has the same configuration as that of the image forming apparatus 100 except for the tandem type.

EXAMPLES

Hereinafter, examples of exemplary embodiment of the invention will be described, but the present invention is not limited to the following examples. In Examples, unless otherwise specified, "part(s)" means "part by weight", and "%" means "% by weight".

Example 1

Preparation of Conductive Substrate

As a conductive substrate, a cylindrical aluminum substrate having a diameter of 30 mm, a length of 340 mm, and a thickness of 0.8 mm is prepared by an impact press method.

Forming of Undercoating Layer 100 parts by weight of zinc oxide as inorganic particles average particle diameter: 70 nm, manufactured by Tayca. Corporation, and BET specific surface area: 15 $m^2/g$) are mixed with 500 parts by weight of methanol by stirring, and 1.25 parts by weight of a silane coupling agent (Compound name: N-2-(aminoethyl)-3-aminopropyl trimethoxy manufactured by Shin-Etsu Chemical Co., Ltd., product name: KM/1603) as a surface treatment agent is added thereto and stirred for 2 hours. Thereafter, the methanol is distilled off by distillation under reduced pressure and baked at 120° C. for 3 hours to obtain zinc oxide particles surface-treated with a silane coupling agent.

44.6 parts by weight of the zinc oxide panicles surface-treated with the silane coupling agent, 0.45 parts by weight of 1-hydroxyanthraquinone as the electron accepting compound, 10.2 parts by weight of blocked isocyanate (SUMIDUR BL 3173, manufactured by Sumitomo Bayer Urethane Co., Ltd.) as the curing agent, 3.5 parts by weight of butyral resin (trade name: ESREX BM-1, manufactured by Sekisui Chemical Co., Ltd.), 0.005 parts by weight of dioctyltin dilaurate as a catalyst, and 41.3 parts by weight of methyl ethyl ketone are mixed, and dispersed for 4 hours in a sand mill using glass beads each having a diameter of 1 mm (that is, dispersing time of first dispersing: 4 hours) to obtain a first dispersion (first dispersing step).

The elastic recovery amount of the first dispersion is 0.12 Pa·s.

Next, a circulation unit in which a stirring tank, a liquid feed pump, and a filter (sieve: 0.03 mm) are connected by a circulation path is prepared.

The obtained first dispersion is circulated for 48 hours (that is, circulation time: 48 hours) under the condition of a liquid feed rate of 160 mL/min using the circulation unit to obtain an undercoating layer-forming coating liquid (circulation step).

Table 1 shows the elastic recovery amount in the obtained undercoating layer-forming coating liquid.

With the undercoating layer-forming coating liquid, a conductive substrate is coated by a dipping coating method at a coating speed of 160 mL/min, and dried and cured at 190° C. for 24 minutes to obtain an undercoating layer having a thickness of 19 μm.

The content of inorganic particles in the obtained undercoating layer is 79% by weight with respect to the entire amount of the undercoating layer.

Formation of Charge Generation Layer

A mixture including 15 parts by weight of hydroxygallium phthalocyanine having diffraction peaks at Bragg angles (2θ±0.2°) of at least 7.3°, 16.0°, 24.9°, and 28.0° in an X-ray diffraction spectrum using a Cu Kα characteristic X-ray as the charge generation substance, 10 parts by weight of vinyl chloride-vinyl acetate copolymer resin (VMCH, manufactured by Nippon Unicar Company Limited) as binder resin, and 200 parts by weight of n-butyl acetate are dispersed by stirring for 4 hours with a sand mill using glass beads having a diameter of 1 mmφ to obtain a dispersion.

175 parts by weight of n-butyl acetate and 180 parts by weight of methyl ethyl ketone are added to the obtained dispersion and stirred to obtain a coating liquid for forming a charge generation layer.

Dipping coating is performed on an undercoating layer with the charge generation layer-forming coating liquid and drying is performed at 140° C. for 10 minutes to form a charge generation layer having a thickness of 0.2 μm.

Formation of Charge Transport Layer

40 Parts by weight of N,N-diphenyl-N,N'-bis(3-methylphenyl)-[1,1']biphenyl-4,4'-diamine, 8 parts by weight of 4-(2,2-diphenylphenyl)-4',4"dimethyl-triphenylamine, and 52 parts by weight of bisphenol Z polycarbonate resin (viscosity average molecular weight: 50,000) are added to 800 parts by weight of chlorobenzene and dissolved to obtain a coating transport layer-forming coating liquid.

Coating is performed on the charge generation layer with the charge transport layer-forming coating liquid and dried at 140° C. for 40 minutes to form a charge transport layer having a thickness of 28 μm.

In this manner, the electrophotographic photoreceptor 1 is prepared.

Table 1 shows results of measurement and calculation of the inorganic particle contact proportion of the undercoating layer and the current reduction rate due to use, in the obtained electrophotographic photoreceptor 1, by the methods.

Example 2

In the formation of the undercoating layer, except that the sieve of the filter in the circulation unit is 0.04 mm, the liquid feed amount in the circulation step is 110 mL/min, and the circulation time in the circulation step is set to 35 hours, an electrophotographic photoreceptor 2 of Example 2 is obtained in the same manner as in the preparation of the electrophotographic photoreceptor 1 of Example 1.

Table 1 shows the elastic recovery amount of the undercoating layer-forming coating liquid, the inorganic particle contact proportion of the undercoating layer, and the current reduction rate due to use in Example 2.

The content of inorganic particles in the undercoating layer obtained in Example 2 is 76% by weight with respect to the entire amount of the undercoating layer.

Example 3

In the formation of the undercoating layer, except that the sieve of the filter in the circulation unit is 0.03 mm, the liquid feed amount in the circulation step is 190 mL/min, and the circulation time in the circulation step is set to 50 hours, an electrophotographic photoreceptor 3 of Example 3 is obtained in the same manner as in the preparation of the electrophotographic photoreceptor 1 of Example 1.

Table 1 shows the elastic recovery amount of the undercoating layer-forming coating liquid, the inorganic particle contact proportion in the undercoating layer, and the current reduction rate in Example 3.

The content of inorganic particles in the undercoating layer obtained in Example 3 is 73% by weight with respect to the entire amount of the undercoating layer.

Example 4

In the formation of the undercoating layer, except that 1.7 parts by weight of a silane coupling agent (Compound name: vinyltriethoxysilane, manufactured by Tokyo Chemical Industry Co., Ltd.) is used as the surface treatment agent, an electrophotographic photoreceptor 4 of Example 4 is obtained in the same manner as in the preparation of the electrophotographic photoreceptor 1 of Example 1.

In Example 4, the elastic recovery amount of the first dispersion is 0.15 Pa·s.

Table 1 shows the elastic recovery amount of the undercoating layer-forming coating liquid, the inorganic particle contact proportion in the undercoating layer, and the current reduction rate in Example 4.

The content of inorganic particles in the undercoating layer obtained in Example 4 is 76% by weight with respect to the entire amount of the undercoating layer.

Comparative Example 1

In the formation of the undercoating layer, except that the second dispersion obtained by further dispersing the first dispersion for 2 hours with a sand mill using glass beads having a diameter of 1 mm is used as the undercoating layer-forming coating liquid in place of the circulation step, an electrophotographic photoreceptor C1 of Comparative Example 1 is obtained in the same manner as in the preparation of the electrophotographic photoreceptor of Example 1.

Table 1 shows the elastic recovery amount of the undercoating layer-forming coating liquid, the inorganic particle contact proportion in the undercoating layer, and the current reduction rate in Comparative Example 1.

The content of inorganic particles in the undercoating layer obtained in Comparative Example 1 is 70% by weight with respect to the entire amount of the undercoating layer Comparative Example 2

In the formation of the undercoating layer, except that the second dispersion obtained by further dispersing the first dispersion for 1 hour with a sand mill using glass beads having a diameter of 1 mm is used as the undercoating layer-forming coating liquid in place of the circulation step, an electrophotographic photoreceptor C2 of Comparative Example 2 is obtained in the same manner as in the preparation of the electrophotographic photoreceptor 1 of Example 1.

Table 1 shows the elastic recovery amount of the undercoating layer-forming coating liquid, the inorganic particle contact proportion in the undercoating layer, and the current reduction rate in Comparative Example 2.

The content of inorganic particles in the undercoating layer obtained in Comparative Example 2 is 71% by weight with respect to the entire amount of the undercoating layer.

Comparative Example 3

In the formation of the undercoating layer, except that the first dispersion is used as the undercoating layer-forming coating liquid as it is, without performing the circulation step, an electrophotographic photoreceptor C3 of Comparative Example 3 is obtained in the same manner as in the preparation of the electrophotographic photoreceptor 1 of Example 1.

Table 1 shows the elastic recovery amount of the undercoating layer-forming coating liquid, the inorganic particle contact proportion in the undercoating layer, and the current reduction rate in Comparative Example 3.

The content of inorganic particles in the undercoating layer obtained in Comparative Example 3 is 73% by weight with respect to the entire amount of the undercoating layer.

Comparative Example 4

In the formation of the undercoating layer, except that the second dispersion obtained by further dispersing the first dispersion for 2 hours with a sand mill using glass beads having a diameter of 1 mm is used as the undercoating layer-forming coating liquid in place of the circulation step, an electrophotographic photoreceptor C4 of Comparative Example 4 is obtained in the same manner as in the preparation of the electrophotographic photoreceptor 4 of Example 4.

Table 1 shows the elastic recovery amount of the undercoating layer-forming coating liquid, the inorganic particle contact proportion in the undercoating layer, and the current reduction rate in Comparative Example 4.

The content of inorganic particles in the undercoating layer obtained in Comparative Example 4 is 69% by weight with respect to the entire amount of the undercoating layer.

Evaluation

Density Unevenness Evaluation

The obtained electrophotographic photoreceptor is measured is mounted on a electrophotographic image forming apparatus (ApeosPort-VI C5571, manufactured by Fuji Xerox Co., Ltd.), and halftone full page images with an image density of 50% are continuously formed on 2 million sheets of A4 paper in an environment of temperature of 25° C. and humidity of 40%. The 2 million sheets of halftone images are visually observed and density unevenness is evaluated in accordance with the following criteria. Results are shown in Table 1.

Evaluation Criteria

A: Density unevenness is not confirmed at all

B: Slight density unevenness is confirmed, but it is allowable

C: Density unevenness is confirmed, but it is allowable

D: Density unevenness is remarkably confirmed

TABLE 1

| | Photoreceptor | Elastic recovery amount (Pa · s) | Inorganic particle contact proportion (%) | Current reduction rate due to use (%) | Density unevenness evaluation |
|---|---|---|---|---|---|
| Example 1 | 1 | 0.74 | 86.9 | 4.0 | A |
| Example 2 | 2 | 0.55 | 82.1 | 9.6 | B |
| Example 3 | 3 | 0.88 | 90.5 | 7.5 | B |
| Example 4 | 4 | 0.86 | 88.7 | 8.1 | B |
| Comparative Example 1 | C1 | 1.20 | 98.6 | 32.0 | D |
| Comparative Example 2 | C2 | 0.90 | 95.4 | 29.2 | C |
| Comparative Example 3 | C3 | 0.12 | 65.2 | 24.3 | C |
| Comparative Example 4 | C4 | 1.10 | 97.8 | 30.0 | C |

From the results, it is found that the electrophotographic photoreceptors of Examples prevent the density unevenness as compared with the electrophotographic photoreceptors of Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoating layer that contains inorganic particles surface-treated with a surface treatment agent, and is provided in contact with an outer peripheral surface of the conductive substrate; and a photosensitive layer provided on the undercoating layer, wherein, with respect to the outer peripheral surface of the conductive substrate, a percentage of an area of the outer peripheral surface being in a state of contact with the inorganic particles is from 82% to 91% when a total area of the outer peripheral surface is considered to be 100%, an area of the outer peripheral surface of the conductive substrate in a state of not being in contact with the inorganic particles is an area that is more than 5 μm from a surface of a closest inorganic particle of the inorganic particles, the total area of the outer peripheral surface of the conductive substrate consists of a sum of the area being in the state of contact with the inorganic particles and the area in the state of not being in contact with the inorganic particles, a content of the inorganic particles in the undercoating layer is 75% by weight or more, and the conductive substrate has a thickness of 0.2 mm to 1.5 mm.

2. The electrophotographic photoreceptor according to claim 1, wherein, when halftone full page images with an image density of 50% are continuously formed on 2 million sheets of A4 paper, a rate of decrease in a value of current flowing from the undercoating layer to the conductive substrate is 20% or less.

3. The electrophotographic photoreceptor according to claim 1, wherein a content of the inorganic particles in the undercoating layer is 78% by weight or more.

4. The electrophotographic photoreceptor according to claim 1, wherein the conductive substrate has a thickness of 0.4 mm to 0.8 mm.

5. A process cartridge that is detachable from an image forming apparatus, the process cartridge comprising:

the electrophotographic photoreceptor according to claim 1.

6. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with a developer including toner to form a toner image; and a transfer unit that transfers the toner image onto a surface of a recording medium.

7. The electrophotographic photoreceptor according to claim 1, wherein the undercoat layer is obtained by coating the conductive substrate with an undercoating layer-forming coating liquid having an elastic recovery amount of 0.30 Pa·sec or more and less than 0.90 Pa·sec, and the elastic recovery amount is an amount of change in shear viscosity due to application of a shear stress with shear rate of 0.1 $sec^{-1}$ after applying a shear stress with shear rate of 1,000 $sec^{-1}$ to the undercoating layer-forming coating liquid.

8. The electrophotographic photoreceptor according to claim 7, wherein the elastic recovery amount is from 0.50 Pa·sec to 0.85 Pa·sec.

9. The electrophotographic photoreceptor according to claim 7, wherein the elastic recover amount is from 0.55 Pa·sec to 0.80 Pa·sec.

* * * * *